United States Patent [19]

Chastain et al.

[11] Patent Number: 4,927,030

[45] Date of Patent: May 22, 1990

[54] METHOD AND APPARATUS FOR DEBRIS SCREENING AND SORTING OF PEANUTS

[75] Inventors: Jack T. Chastain; John McWhorter, both of Rochelle, Ga.

[73] Assignee: Doster Warehouse, Rochelle, Ga.

[21] Appl. No.: 268,156

[22] Filed: Nov. 7, 1988

[51] Int. Cl.[5] ..... B07B 1/10

[52] U.S. Cl. ..... 209/620; 209/259; 209/933

[58] Field of Search ..... 209/620, 622, 665, 668, 209/307, 258, 255, 256, 617, 676, 933, 659, 660, 259

[56] References Cited

U.S. PATENT DOCUMENTS

| | | | |
|---|---|---|---|
| 371,433 | 10/1887 | Cornwall | 209/556 |
| 555,973 | 3/1896 | Risley et al. | 209/676 |
| 1,694,724 | 12/1928 | Rogers | 209/620 |
| 3,236,375 | 2/1966 | Brenner et al. | 209/617 |
| 3,459,301 | 8/1969 | Gray | 209/620 X |
| 3,589,515 | 6/1971 | Krolopp | 209/620 X |

FOREIGN PATENT DOCUMENTS

| | | | |
|---|---|---|---|
| 73696 | 10/1893 | Fed. Rep. of Germany | 209/620 |
| 20237 | 8/1904 | United Kingdom | 209/258 |
| 490508 | 9/1938 | United Kingdom | 209/620 |

*Primary Examiner*—Donald T. Hajec

*Attorney, Agent, or Firm*—Jones, Askew & Lunsford

[57] ABSTRACT

A sorting apparatus to remove sticks, weeds and other debris from a batch of peanuts and sort the peanuts into size categories. At least two longitudinally spaced apart sets of endless belts wrap over separate sets of drive rollers. The belts are interposed to position a belt from one set adjacent a belt from another set. The sets of belts travel at different speeds to move peanuts and debris into the longitudinal gaps between the belts. Debris, such as sticks and peanuts transverse to the belts are induced by the relative movement of the belts to align longitudianally into the gap between adjacent belts. Peanuts and debris smaller than the gap fall through into a hopper and larger peanuts and debris fall into a separate hopper. Larger debris falls off the end of the apparatus where the endless belts turn over a drive roller from a horizontal direction to a downward direction.

8 Claims, 4 Drawing Sheets

METHOD AND APPARATUS FOR DEBRIS SCREENING AND SORTING OF PEANUTS

TECHNICAL FIELD

The present invention relates to an apparatus for removing debris from harvested raw peanuts and for sorting the peanuts. More particularly, the present invention relates to a debris removing and peanut sorting apparatus having sets of spaced apart belts, with each set travelling at a different speed and to an apparatus more easily changed to select the sort size of peanut.

BACKGROUND OF THE INVENTION

Raw unshelled peanuts are picked by harvesters from peanut crop fields. Together with the peanuts, the harvesters also pick up debris such as cans, sticks, branches, weeds and the like. Sometimes shovel or other large tool is found in the batch of raw peanuts hauled by a track to a peanut warehouse. Such debris must be removed or "cleaned" from the batch of peanuts before product processing on the peanuts may occur.

One known peanut cleaner/sorter machine uses spaced apart rotating belts as screens to clean debris from a batch of peanuts. The cleaner/sorter has a frame assembled from tubes. Four tubes connect together with upper and lower horizontal side tubes to form a substantially rectangular frame. Four rotatable shafts mount in spaced relation on the upper side tubes transverse to the longitudinal axis of the cleaner/sorter. The two inside shafts mount vertically higher than the outside shafts. Two rotatable shafts mount to the lower side tubes transverse to the longitudinal axis. A plurality of endless spaced apart belts loop over the shafts with a gap between adjacent belts. One of the shafts mounted to the lower side tube connects to an adjustor which translates the shaft with respect to the longitudinal axis of the cleaner/sorter. Moving the adjustable shaft away from the longitudinal midpoint tightens the belts around the shafts.

A motor attached to the outside of the cleaner/sorter frame connects to one of the shafts. The motor turns the shaft which causes the belts to rotate.

An open planar feeding unit mounts above the surface defined by the spaced apart belts. The feeder slopes because one end is positioned higher than the other end. A motor mounted on the feeder turns an offset cam. The motor and offset cam cause the feeder unit to shake. Peanuts poured in the feeding unit thus are shaken and caused to slide off the feeder unit onto the rotating belts.

The rotating belts spread out the pile of peanuts and move the peanuts towards the other end of the cleaner/sorter. Peanuts and debris smaller than the gap between the belts fall through and into a hopper. Larger debris travels on the top surface of the belts and falls off the cleaner/sorter when the belts wrap over the end shaft from a horizontal position to a downward position towards the lower drive shaft. The collected peanuts and debris funnel from the hopper through a spout to other peanut processing machines for further debris removal, cleaning, and product processing.

This machine has drawbacks which limit its capacity and usefulness for cleaning and sorting of peanuts. Particularly, peanuts and debris travelling on the belts may ride on the top of a moving belt, but to be sorted, the peanuts and debris must fall into the longitudinal gaps between adjacent belts. Metal fingers extend downwardly towards the surface of the belts from a bar transverse to the longitudinal axis. The fingers help push peanuts and debris into the gaps between the belts, but the fingers are not completely effective and some peanuts travel across the machine riding on top of a belt.

Further, the machine may be set to separate larger peanuts from standard size peanuts, but the large debris, such as sticks, cans, and weeds, collect with the large peanuts at the end of the sort bed. Subsequent processing must then clean not only the debris which is about the size of the peanuts, but must also process again the large debris to clean it from the peanuts.

Peanuts collect in a hopper and pass through a funnel on one side of the machine. It is desirable to position the funnel adjacent the next processing machine. One funnel, however, causes problems with locating the machine. Equipment changes in the warehouse or moving the machine to another farm with different equipment may cause the outlet funnel to be blocked or make it otherwise impractical to handle peanuts coming from the funnel.

BRIEF DESCRIPTION OF THE INVENTION

The present invention solves the above-described problems by providing a sorting bed of offset sets of belts traveling at different speeds to more quickly screen raw peanuts and by providing debris screening mechanisms to eliminate the large debris from the processing.

More particularly described, the present invention provides a peanut debris cleaning and sorting apparatus having a support frame, a sorting bed, and a feeder table. The sorting bed is substantially horizontal surface defined by at least two sets of spaced apart belts. Each set is longitudinally spaced relative to the other set of belts. Each set comprises a plurality of spaced apart endless belts wrapped around roller shafts and interposed to position a belt of one set adjacent, but spaced apart from, a belt of another set.

The roller shafts mount transverse to the longitudinal axis of the frame on lateral side members. One of the roller shafts connects to a drive motor. The drive shaft turns a sprocket. A chain connects to a different size sprocket on the shaft for an adjacent set of belts. Thus, the motor drives each set of spaced apart belts at different speeds. A feeder table mounted to the top of the frame receivers a batch of peanuts. The feeder table is shaken to slide the peanuts onto the alternately disposed belts.

The relatively moving belts twist and turn the peanuts and debris and cause the peanuts nd debris to move into the gap between the belts. Peanuts and debris smaller than the gap fall through into a hopper and slide through a funnel for collection and processing by other peanut equipment. A handle moves a baffle plate to select alternate funnels to dispense the peanuts. Larger peanuts and debris fall for collection into a separate hopper. Large debris such as sticks and weeds are carried on the top surface of the belts and fall off the end into a debris collector.

Accordingly, it is an object of the present invention to provide an improved debris removal apparatus for processing raw, harvested peanuts.

Another object of the present invention is to provide an apparatus having increased capacity for processing raw, harvested peanuts.

Still another object of the present invention is to provide an apparatus for locating and separately collecting larger sized peanuts.

An object of the present invention is to separate and to collect for disposal larger debris.

A further object of the present invention to provide an adjustable apparatus which can be easily changed to select the sort size of peanuts.

Yet another object of the present invention is to provide a peanut collection hopper with selectable outlet funnels.

Other objects, features and advantages of the present invention will become apparent upon reading the following detailed description of the disclosed embodiment in conjunction with the appended drawing and claims.

DETAILED DESCRIPTION OF THE PREFERRED EMBODIMENTS

Figure 1:
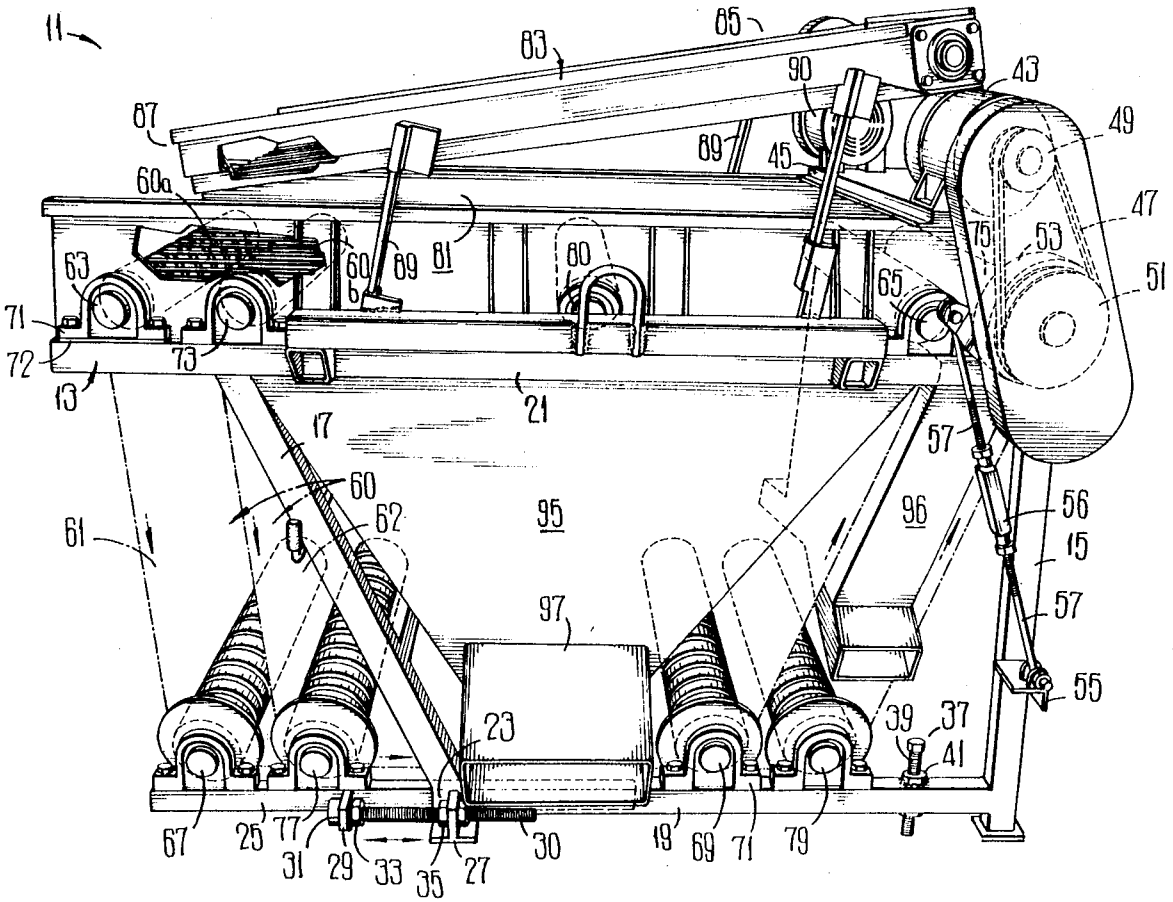
FIG. 1 is a perspective partially cut-away side view of a disclosed embodiment of a peanut debris cleaning and sorting apparatus according to the present invention.

Referring now in more detail to the drawing, in which like numerals indicate like parts throughout the several views, FIG. 1 illustrates in perspective a partially cut-away view of a peanut debris cleaning and sorting machine 11 in accordance with the present invention. A frame 13 preferably is assembled from tubular steel members. The frame 13 includes a pair of vertical rear supports 15, a pair of front supports 17, a pair of lower side members 19, and a pair of upper side members 21. The front supports 17 connect adjacent the end 23 of the lower side tube 19. The end 23 is open to receive a shaft support tube 25 which telescopes longitudinally in and out of the lower side tube 19. A flange 27 extends from the side tube 19 adjacent its end 23. A second flange 29 extends from the shaft support tube 25. A threaded bolt 30 extends through a bore in the flange 29, through a nut 33 adjacent the bore 31, through a second nut 35 welded to the flange 27, and through a bore in the flange 27.

A screw jack 37 connects to the side tube 19 adjacent the connection between the side tube 19 and the rear support 15. The screw jack 37 includes a threaded rod 39 which threads through a nut 41 welded to the side tube 19.

A drive motor 43 mounts on a support 45. A belt 47 connects between a pulley 49 on the drive motor and a pulley 51 connected to a speed reducer 53. A support flange 55 extends laterally from the rear support 15. A turnbuckle 56 and threaded rods 57 connect between the speed reducer 53 and the flange 55. The threaded rod 57 pivotally connects to the flange 55.

Figure 3:
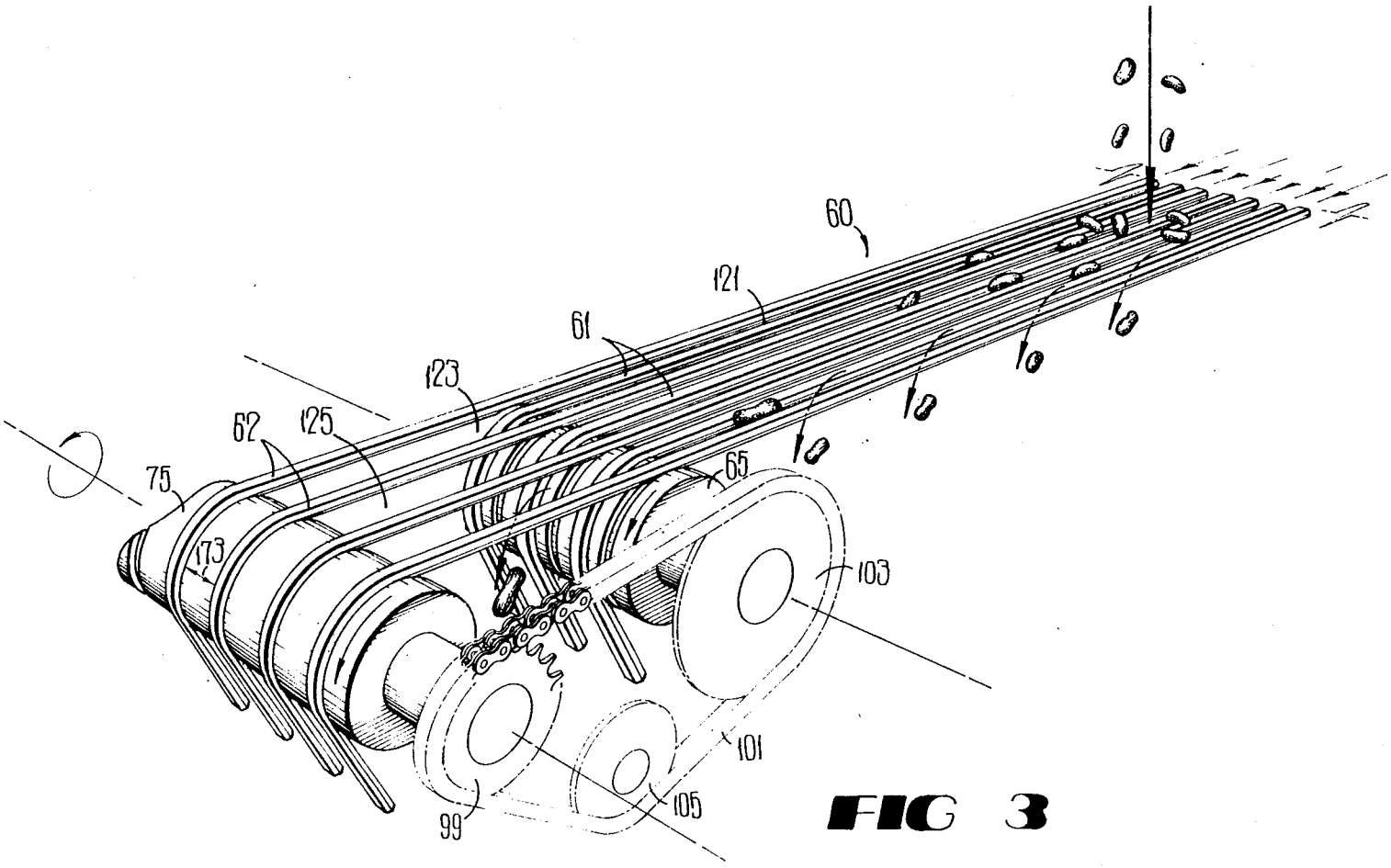
FIG. 3 is an isolated perspective view of the sort surface defined by spaced apart belts and the associated gearing of the peanut debris cleaning and sorting apparatus shown in FIG. 1.

The frame 13 supports a plurality of sets of belts 60 which turn on shafts mounted transverse to the longitudinal axis of the cleaner/sorter 11. The sets of belts 60 define a surface on which the peanuts travel. The illustrated embodiment includes two sets 61 and 62 of spaced apart belts 60 as best shown in FIG. 3. Each set 61 and 62 of belts travel over separate sets of rollers. In the illustrated embodiment, each set travels over four rollers. An alternate embodiment (not illustrated) uses three rollers with two rollers mounted to the upper side tube and one roller mounted to the lower side tube. In this embodiment, the hopper for collecting the sorted peanuts cannot be as deep as in the illustrated embodiment to provide adequate clearance for belt travel. The rollers for the set 61 of belts include an upper front roller 63, an upper back roller 65, a lower front roller 67 and a lower back roller 69. The rollers 63, 65, 67 and 69 mount transverse to the longitudinal axis of the cleaner/sorter 11. The upper rollers 63 and 65 mount to the upper side tubes 21. The lower front roller 67 mounts to the shaft support tubes 25. The lower back roller 69 mounts to the lower side tubes 19. The ends of the shafts 63, 65, 67 and 69 are supported in bearing mounts 71 which bolt to the upper side tubes 21, the lower side tubes 19 and to the shaft support tube 25. A bearing plate 72 connects between the bearing mount 71 and the support tube 21.

The second set 62 of belts similarly connects to a set of four rollers. The second set of rollers includes an upper front roller 73, an upper back roller 75, a lower front roller 77, and a lower back roller 79. As illustrated, the sets 61 and 62 of belts and rollers are laterally offset with respect to each other. The belts 60 in each set 61 and 62 are spaced apart, and the sets 61 and 62 of belts 60 are interposed to position a belt **60*a* from the set 61 adjacent a belt 60*b* from the set 62**.

An intermediate support roller 80 mounts to the upper side tubes 21 between the front roller 73 and the back roller 65. The belts 60 travel over the roller 80 which in a preferred embodiment mounts vertically higher than the rollers 63, 65, 73 and 75. This creates a slight hill in the middle of the surface defined by the belts 60.

A pair of sidewalls 81 mount to the top of the frame 13 and extend upwardly on the sides of the cleaner/sorter 11. A feeder table 83 also mounts to the top of the frame 13. One end 85 of the feeder 83 is positioned higher than the other end 87. Four flexible members 89 connect the feeder 83 to the frame 13. A motor 90 mounts to the support 45 and connects to an offset cam (not shown). The cam connects to the feeder 83.

Figure 4:
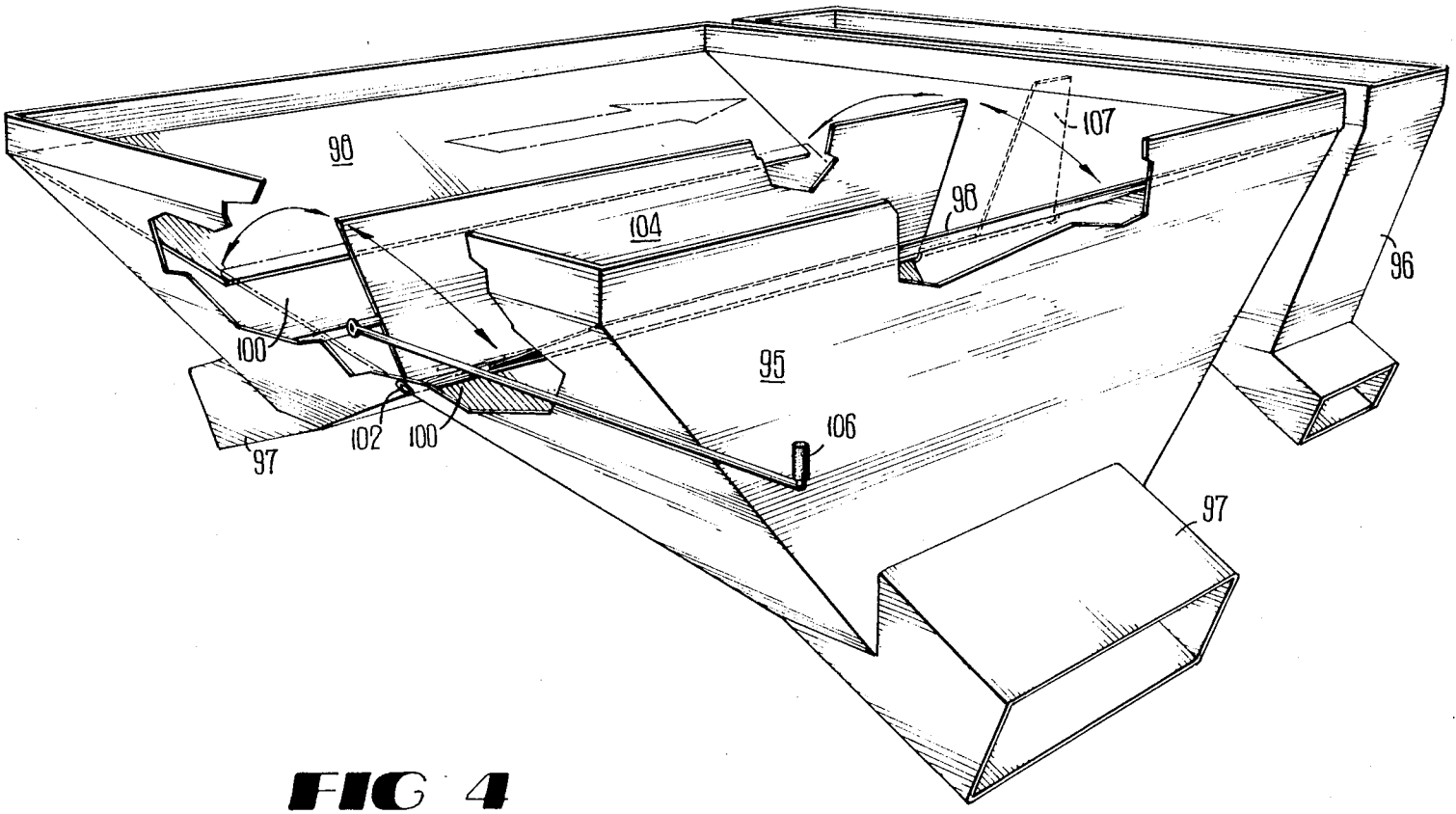
FIG. 4 is a perspective view of a disclosed embodiment of the present invention illustrating the main hopper baffle which directs sorted peanuts to one of the alternate, selectable funnels.

A hopper 95 mounts to the upper side tubes 21 below the horizontal surface defined by the belts 60 extending between the front and back rollers 63, 73 and 65, 75. In the illustrated embodiment, a funnel 97 extends from each side of the hopper 95. As is shown in FIG. 4, the hopper 95 includes a pair of slides 98 which define openings 100 into the funnels 97. A rotatable shaft 102 extends through the hopper 95. A baffle plate 104 connects on one side to the shaft 102. A handle 106 on the outside of the hopper 95 connects to the baffle plate 104. A second hopper 96 mounts to the upper side tubes 21 between the back rollers 65 and 75. In an alternate embodiment, the shaft 102 extends through the hopper 95 and into the hopper 96. A baffle plate 107 (shown in phantom) in the hopper 96 similar to the baffle plate 104 mounts to the rotatable shaft 102. Thus, moving the handle 106 to reposition the baffle plate 104 also repositions the baffle plate 107 in the hopper 96. In this way, the peanuts exit from the hoppers on the same side.

Figure 2:
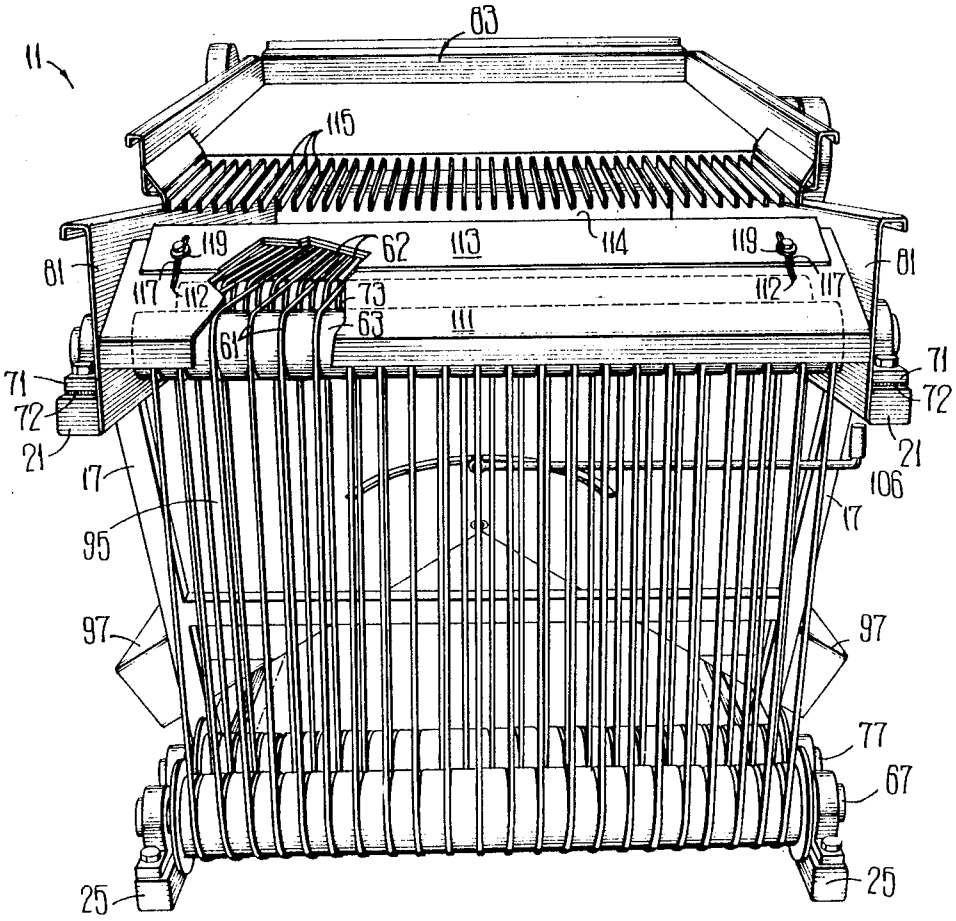
FIG. 2 is a front side perspective view of a feeder table and scalp which provides the initial cleaning of the peanuts in the peanut cleaning and sorting apparatus illustrated in FIG. 1.

FIG. 2 illustrates a front perspective view of the cleaner/sorter 11 of the present invention. The open top hopper 95 connects to the sidewalls 81 and the upper side tubes 21. A transverse plate 111 mounts between the side walls 81 and extends toward the feeder 83. The plate 111 has a pair of slots 112. A second movable transverse plate 113 attaches to the transverse plate 11. The plate 113 includes a pair of slots 117. Bolts 119 extend through the slots 112 and 117 to connect the plates 111 and 113 together. A plurality of spaced apart fingers 115 extend from the feeder 83 towards the plate 113. The ends of the fingers 115 and the plate 113 define a gap 114.

FIG. 3 is an isolated perspective view of the spaced apart sets 61 and 62 of belts and the gearing which turns the sets 61 and 62 of belts 60 at different speeds. The speed reducer 53 connects to one end of the upper back roller 75. A sprocket 99 connects to the other end of the back roller 75. A chain 101 travels between the sprocket 99 and a second sprocket 103 which connects to the back roller 65 of the first set 61 of belts 60. A travel sprocket 105 connects to the upper tube 21 and is turned by the chain 101. The belts of set 61 turn over the back roller 65, while the belts of set 62 turn over the back roller 75. The belts 60 are spaced apart to define a gap 121 through which peanuts and debris fall into the hopper 95. The back roller 65 of the first set 61 of belts is longitudinally displaced with respect to the back roller 75 of the second set 62 of belts. This creates a gap 125 between the rollers 65 and 75. Select peanuts too large to fall between the gap 121 fall through the gap 125.

The rotatable belts 60 are first installed before the cleaner/sorter 11 of the present invention is operated. As illustrated in FIG. 1, the screw jack 37 raises one side of the frame 13 permitting access to the cleaner/-corter 11 for removal and installation of the belts 60. The threaded rod 39 is turned in a first direction to raise the frame 39 and turned in the opposite direction to lower the frame 39. The illustrated embodiment has two sets 61 and 62 of belts 60 spaced apart longitudinally. The rollers 63, 65, 67 and 69 for the belt set 61 and the rollers 73, 75, 77 and 79 for the belt set 62 must be removed from the frame 13 to install or replace belts 60. The belts 60 from each set 61 and 62 loop over the upper front roller 73, the upper back roller 65, the lower front roller 77 and the lower back roller 69. Thus, as illustrated, the innermost rollers 65, 69, 73 and 77 receive belts 60 from both sets 61 and 62. The outer rollers 63, 67 and 75, 79 receive belts from one set 61 or the other set 62, respectively.

The rollers 67 and 77 are last to be attached to the frame 13. The tube 25 on which the rollers 67 and 77 mount is fully inserted into the lower side member 19 until stopped by the bearing mount 71 for the roller 77. The sets 61 and 62 of belts thus are relatively loose around the rollers.

The belts 60 in the sets 61 and 62 are tightened around the rollers by turning the threaded bolt 30 on each side of the cleaner/sorter 11. The bolt 30 turns in the flange 27 of the side tube 19 and the flange 29 of the shaft support tube 25. Turning the bolt 30 moves the support tube 25 longitudinally with respect to the side tube 19. When the bolt 30 turns in a first direction, the tube 25 telescopes from the end of the tube 19. This movement translates the rollers 67 and 77 from the longitudinal middle of the frame 13 towards the frame end. Turning the bolt 30 in a second opposite direction translates the tube 25 into tube 19 and thereby relaxes the tension on the belts 60.

As described above, one end of the roller 75 connects to the speed reducer 53. Thee opposite end of the front roller 75 connects to the sprocket 99 as illustrated in FIG. 3. The sprocket 99 turns and drives the chain 101 which turns the second sprocket 103. The second sprocket 103 is of a different size than the sprocket 99. Thus the roller 65 rotates at a speed different than that of the roller 75. The sets 61 and 62 of belts 60 wrapped tightly around the rollers turn at different speeds.

After the belts 60 are installed and adjusted, the peanut cleaner/sorter 11 may be operated. With continued reference to FIG. 1, the drive motor 43 is started. The turnbuckle 56 adjusts the tension on the drive belt 47. The speed of the belts 60 may be changed by changing the pulley 49 or using a variable speed pulley. The motor 90 connected to the feeder table 83 is started. The motor 89 and offset cam 93 cause the feeder 83 to shake vigorously. Raw peanuts are dumpd on the feeder table 83 and, shaken by the motor 90, slide towards the low end 87 of the feeder 83. The four flexible members 89 connecting the feeder 83 to the frame 13 permit the feeder table 83 to shake. Peanuts sliding down the feeder table fall between the fingers 115 (as best illustrated in FIG. 2) to the sort surface defined by the tops of the belts 60. Branches, sticks and other large debris slide across the fingers 115 towards the gap 114 between the fingers 115 and the plate 113. Most of such debris slides over the gap 114, across the plate 113 and off the front end of the peanut cleaner/sorter 11. Some debris however falls through the gap 114 with the peanuts. This is desirable because such debris may include other peanuts which are shaken off the debris by the moving belts 60, sorted and collected. Should too much or too little debris fall through the gap 114, the gap 114 may be adjusted. The bolts 119 extending through the slots 112 of the plate 111 and the slots 117 of the plate 113 are loosened temporarily to enable repositioning the plate 113 with respect to the ends of the fingers 115.

With reference to FIGS. 3 and 4, peanuts falling on the belts 60 are moved towards the opposite end of the peanut cleaner/sorter. Many peanuts fall into the longitudinal gap 121 between the belts 60. Peanuts and debris which fall transverse across the belts 60 of a set 61 and a set 62 are caused to twist or turn rapidly due to the difference in speeds of the belts on which the peanuts or debris rest. This rapid twisting motion aligns the peanuts or debris longitudinally with resepct to the belt and encourages the peanuts or debris to fall into the gap 121. Peanuts smaller than the gap 121 fall into the hopper 95. The peanuts travel down the slide 98 and across the baffle plate 104. After dropping through the opening 100, the peanuts exit the hopper 95 through the selected funnel 97. One funnel or the other may be selected by moving the handle 106 on the outside of the hopper 95. Moving the handle 106 pivots the baffle plate 104 around the shaft 102.

Peanuts and debris larger than the gap 121 are moved along by the moving belts 60. The larger peanuts travel over the back roller 65. Here the first set 61 of belts 60 change from a first horizontal direction to a second downward direction. The gap 121 is replaced by the gap 123 between the belts 60 of the second set 62. Larger peanuts and debris fall through the gap 125 between the rollers 65 and 75 into the separate second hopper 96. These larger peanuts collected in the hopper 96 are directed through a funnel out of the peanut cleaner/sorter 11 for further separate processing. Debris larger than the gap 123 between adjacent belts of the set 62 falls off the end of the machine at the back roller 75 in a pile to be collected and thrown away or used for other purposes.

The present invention using two sets 61 and 62 of parallel belts travelling at different speeds provides a peanut cleaner/sorter apparatus which can process an increased volume of peanuts. The gap 121 may be adjusted as necessary during processing. The cleaner/-sorter 11 is stopped and the bolts holding the bearing mounts 71 for the shaft 63 are loosened. The bearing plate 72 is inserted as a shim to raise the height at which the shaft 63 sits. The bolts are tightened to lock the bearing mount 71 in place. Raising the shaft 63 changes the angle at which the belts 60 of the set 61 travel. Increasing the angle at which the first set 61 travel with respect to the second set 62 increases the gap 121 between the belts 60 of the first set 61 and the second set 62. Similarly, the gap 121 may be decreased by removing the shim from the bearing mounts 71. In an alternate embodiment, a threaded bolt (not shown) extends through the bearing mount 71 and contacts the frame, whereby turning the bolt in one direction raises the bearing plate with respect to the frame and turning the bolt in an opposite direction lowers the bearing plate with respect to the frame.

In an alternate embodiment (not illustrated), a skirt hangs from a support rod extending between the two sidewalls 81. The skirt extends downwardly to a point just above the surface defined by the belts 60. The skirt skims the heap of peanuts received from the feeder to help spread the peanuts over the sort surface.

Providing a plurality of sets of belts travelling over separate rollers permits the cleaner/sorter 11 to sort peanuts into size grades. The illustrated embodiment collects the more valuable larger peanuts in the second hopper 96 separate from the standard size peanuts.

The principles, preferred embodiments and modes of operation of the present invention have been described in the foregoing specification. The invention is not to be construed as limited to the particular forms disclosed, because these are regarded as illustrative rather than restrictive. Moreover, variations and changes may be made by those skilled in the art without departing from the spirit of the invention as described by the following claims.

What is claimed is:

1. A peanut debris cleaning and sorting apparatus comprising:

at least two sets of sorting belts defining a substantially horizontal surface, each set longitudinally offset relative to the adjacent set, the sets interposed to position a belt from one set adjacent a belt from another set, each set comprising a plurality of endless belts spaced apart to define a gap between adjacent belts;

at least two upper deive shafts for each set of belts;

at least one lower drive shaft for each set of belts;

a motor connected to one drive shaft of one set of sorting belts;

sprocket means connected between the motor driven shaft of the one set of sorting belts and a drive shaft of each other set of sorting belts to drive each set of sorting belts at different speeds; and means for changing the vertical position of one upper drive shaft of one set of belts relative to the upper drive shafts of the other set of belts, whereby the gap between adjacent belts is changed.

2. The peanut debris cleaning and sorting apparatus as recited in claim 1, further comprising collection means to receive sorted peanuts.

3. The peanut debris cleaning and sorting apparatus as recited in claim 2, wherein the collection means comprises:

a first hopper to receive peanuts and debris falling between a belt of the first set and a belt of the second set; and a second hopper to receive larger peanuts and debris falling between adjacent belts of the second set.

4. The peanut debris cleaning and sorting apparatus as recited in claim 1, further comprising a frame.

5. The peanut debris cleaning and sorting apparatus as recited in claim 4, further comprising a feeder table mounted to the frame to receive a batch of peanuts.

6. The peanut debris cleaning and sorting apparatus as recited in claim 5, further comprising shaker means attached to the feeder table to induce the batch of peanuts to slide from the feeder table to the substantially horizontal surface.

7. The peanut debris cleaning and sorting apparatus as recited in claim 1, wherein the change means comprises a removable bearing plate on which the one upper drive shaft mounts.

8. A peanut debris cleaning and sorting apparatus comprising:

a frame;

a first set of sorting belts and a second set of sorting belts defining a substantially horizontal surface, the first set longitudinally offset relative to the second set, the belts interposed to position a belt from the first set adjacent a belt from the second set, each set comprising:

a plurality of endless belts spaced apart to define a gap between adjacent belts;

two upper drive shafts; and two lower drive shafts;

motor means to drive the first set at a speed different from the speed of the second set;

a first hopper to receive peanuts and debris falling through the gap between adjacent belts of the first set and the second set;

a second hopper to receive peanuts and debris falling through the gap between adjacent belts of the second set;

a first and a second funnel to communicate peanuts from the first hopper;

a third and fourth funnel to communicate peanuts from the second hopper;

a rotatable shaft extending extending axially through the first hopper and the second hopper;

a first plate connected to the shaft in the first hopper and a second plate connected to the shaft in the second hopper; and a handle connected to the shaft to move the first and the second plates from a first position blocking flow through the first funnel and the third funnel, respectively, to a second position blocking flow through the second funnel and the fourth funnel, respectively.

* * * * *